US007217100B2

(12) United States Patent
Benderradji et al.

(10) Patent No.: US 7,217,100 B2
(45) Date of Patent: May 15, 2007

(54) HOLDING SYSTEM FOR A ROTOR END PLATE

(75) Inventors: Kamel Benderradji, Livry sur Seine (FR); Marc Marchi, Le Mee sur Seine (FR)

(73) Assignee: Snecma Moteurs, Paris (FR)

( * ) Notice: Subject to any disclaimer, the term of this patent is extended or adjusted under 35 U.S.C. 154(b) by 23 days.

(21) Appl. No.: 10/893,259

(22) Filed: Jul. 19, 2004

(65) Prior Publication Data

US 2005/0042108 A1 Feb. 24, 2005

(30) Foreign Application Priority Data

Jul. 17, 2003 (FR) ..... 03 08713

(51) Int. Cl.
*F01D 5/30* (2006.01)

(52) U.S. Cl. ..... 416/221

(58) Field of Classification Search ..... 416/221
See application file for complete search history.

(56) References Cited

U.S. PATENT DOCUMENTS 4,304,523 A * 12/1981 Corsmeier et al. ..... 416/221

* cited by examiner

*Primary Examiner*—Richard A. Edgar
(74) *Attorney, Agent, or Firm*—Oblon, Spivak, McClelland, Maier & Neustadt, P.C.

(57) ABSTRACT

A device for holding an annular end plate against a radial face of a rotor disc, the disc having in the radial face an annular recess behind a collar extending radially outwards, and the end plate having, in its radially inner part, an annular base bearing against the radially outer wall of the recess and a foot extending radially inwards in the recess from the base, the device including a split annular retaining ring disposed in the recess. The ring is constituted by a snap ring interposed axially between the foot of the end plate and the collar and the peripheral surface of which butts against the base, the peripheral surface and the collar comprising, when joined, notches, which open radially outwards and are intended to receive compression tools for the snap ring, which tools retract into the contour of the collar during the assembly or disassembly of the end plate.

19 Claims, 4 Drawing Sheets

HOLDING SYSTEM FOR A ROTOR END PLATE

CROSS REFERENCE TO RELATED APPLICATIONS

This application is based upon and claims priority under 35 U.S.C. §119 from French Patent Application No. 03 08713, filed Jul. 17, 2003.

FIELD OF THE INVENTION

The invention relates to a device for holding an annular end plate against a radial face of a rotor disc.

It relates more precisely to a device for holding an annular end plate against a radial face of a rotor disc, the said disc having in the said radial face an annular recess delimited by a plurality of walls, one of which is formed by the inside face of a collar extending radially outwards, and the said end plate having, in its radially inner part, an annular base bearing against the radially outer wall of the recess and a foot extending radially inwards in the recess from the base, the said device comprising a split annular retaining ring disposed in the recess, this ring having a first radial surface butting against the inside face of the collar, a second radial surface butting against the axially outside face of the foot and a peripheral surface butting against the said foot or the said base.

BACKGROUND OF THE INVENTION

Such a device is known by virtue of FR A 2 485 117, equivalent to U.S. Pat. No. 4,304,523. In this document, the end plate is designed to prevent the axial displacement of blades of the fir tree root type, the feet of which are mounted in axial notches provided on the periphery of the rotor disc. In order to mount the end plate, the split annular ring is firstly placed in the recess in the disc, after which it is radially compressed towards the inside of the recess by means of tools bearing upon the peripheral wall of the ring, until these tools come to bear upon the collar of the disc. Next, the base of the end plate is slid along the radially outer wall of the recess.

An axial force is exerted against the end plate in order that the foot comes to bear against the inside radial wall of the recess. The tools which compressed the annular ring are then slackened and the latter expands radially outwards.

Next, the axial force exerted upon the end plate is relieved. The ring has at its axially inner end a peripheral rabbet, in which the radially inner portion of the foot finds accommodation. The outer diameter of the ring is less than the inner diameter of the base of the end plate in order to allow the disengagement of the compression tools during assembly and their introduction during possible disassembly. The diameter of the bore in the foot of the end plate is greater than the diameter of the collar to allow the introduction of the inside portion of the end plate into the recess around the compression tools bearing against the periphery of the collar.

Since the end plate is subjected to axial stresses in the event of impacts upon the blades resulting from the ingestion of debris, which stresses are absorbed by the retaining ring, shearing torques are generated upon the ring owing to diameter deviations between the bore in the foot and the collar. This requires the retaining ring to be solid, yet sufficiently flexible to allow its compression and installation in the recess. The manufacture of this ring calls for costly machining.

FR 2 812 906 has proposed a modified retaining ring which, on the periphery of its outside radial face, has a chamfer which allows the said ring to be automatically compressed as the foot of the end plate passes through in the course of assembly. This foot comprises notches to allow the introduction of compression tools for the ring for disassembly purposes. This ring is also solid and calls for costly machining.

It should be noted that the retaining ring remains in the recess whilst the end plate is disassembled for the repair or replacement of a blade, for example. This ring is thus different from a traditional circlip, which is expanded by means of a part in order to be fitted around a shaft and which retracts elastically into a groove made in the periphery of the shaft.

SUMMARY OF THE INVENTION

The object of the invention is to propose an axial holding system for a rotor disc end plate, which system is simple to produce and inexpensive and allows parts to be more easily assembled.

This object is achieved by the fact that the ring is constituted by a snap ring interposed axially between the foot of the end plate and the collar and the peripheral surface of which butts against the base, the said peripheral surface and the said collar comprising, when joined, notches, which open outwards and are intended to receive compression tools for the said snap ring, which tools retract into into the contour of the collar during the assembly or disassembly of the said end plate.

Very advantageously, the radially inner portion of the snap ring is accommodated in a slot made behind the collar.

This slot preferably has a U-shaped section and the snap ring has flat, opposing radial faces. The axial width of the slot is equal to or slightly greater than the thickness of the snap ring.

The foot of the end plate has a bore, the diameter of which is substantially equal to the diameter of the collar.

BRIEF DESCRIPTION OF THE DRAWINGS

Other advantages and characteristics of the invention can be derived from a reading of the following illustrative description and with reference to the appended drawings, in which.

DETAILED DESCRIPTION OF THE INVENTION

Figure 1:
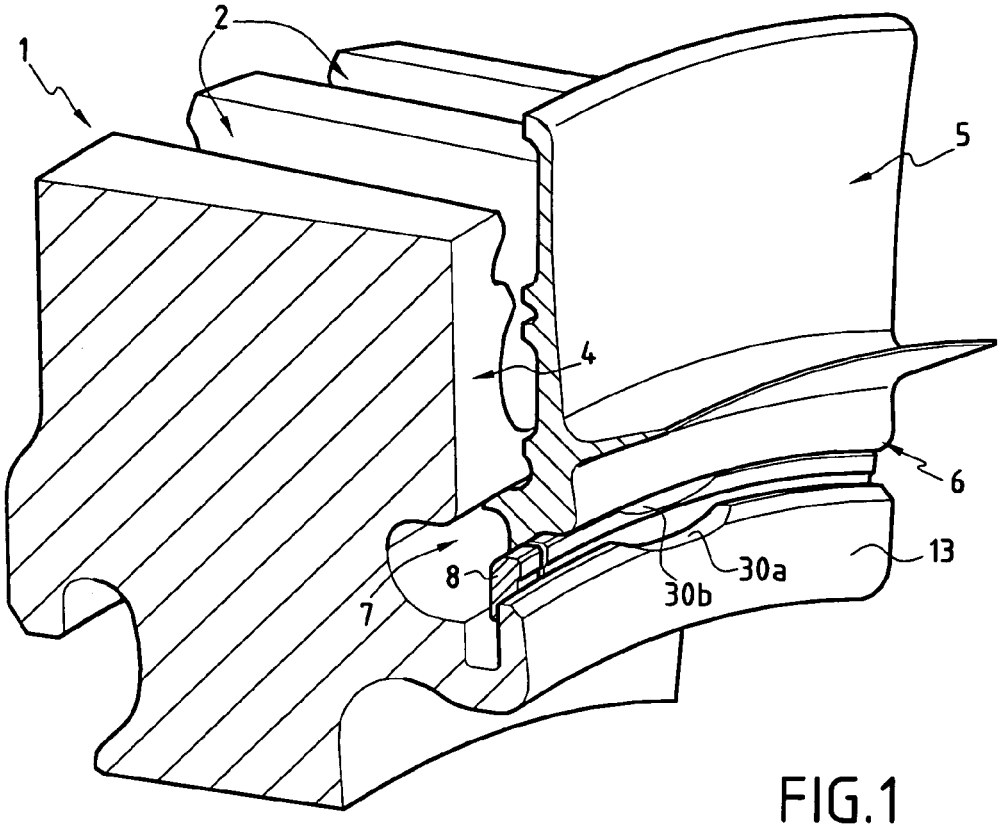
FIG. 1 is a perspective view of a part of a rotor disc of a turbo engine equipped with a holding end plate for blades, which blades are omitted from this figure for the sake of clarity.
Figure 2:
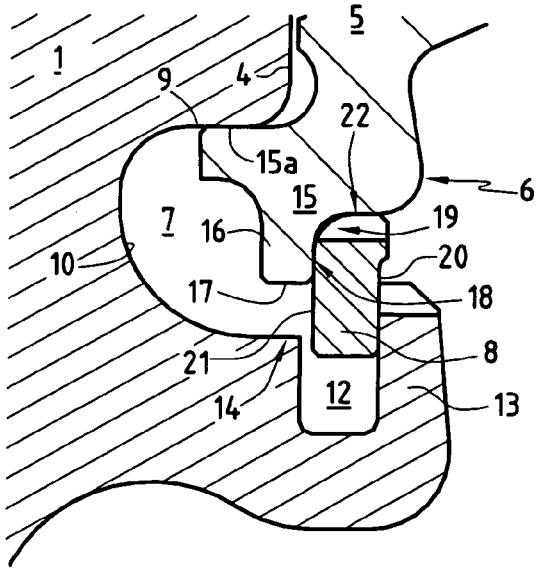
FIG. 2 is a section along a plane containing the rotation axis of the bladed disc of FIG. 1.

The drawings show a disc 1 of a turbo engine, which comprises on its periphery a plurality of substantially axial cells 2, intended to receive feet of blades 3 extending radially outwards. These blades are axially immobilized, on at least one face 4 of the disc 1, by an annular end plate 5, the radially inner portion 6 of which is accommodated in an annular recess 7 made in the face 4 and is immobilized there by a retaining ring, which, according to the invention, appears in the form of a split snap ring 8.

In the present specification, the terms "inner" and "outer" denote a wall or a surface respectively near to or remote from the rotation axis of the disc, and the terms "inside" and "outside" denote a wall or a surface respectively near to or remote from the mid-plane of the disc 1.

The annular recess 7 is delimited radially on the outside by a substantially cylindrical wall 9 connected by a concave surface 10 to an annular slot 12, of U-shaped section, disposed behind a collar 13 which extends radially outwards and the diameter of which is slightly greater than the diameter of the shoulder 14 formed by the concave surface 10 and the inside axial face of the slot 12.

In the example shown in the drawings, the slot 12 and the collar 13 emerge onto the face 4 of the disc 3, but this arrangement is not obligatory for the realization of the invention.

The radially inner portion 6 of the end plate 5 has a base 15, which extends in the recess 7 and which has a cylindrical peripheral surface 15*a* bearing against the cylindrical wall 9, as well as a foot 16 disposed beneath the base 15 and extending radially inwards. The diameter of the bore 17 in the foot 16 is substantially equal to or slightly greater than the diameter of the collar 13 in order to allow the introduction of the radially inner portion 6 of the end plate 5 into the recess 7 during the assembly, or its withdrawal for the purposes of repair or maintenance of the blades 3. The outside face 18 of the foot 16 is disposed in a radial plane passing into the slot 12 in the vicinity of the shoulder 14. This face 18 connects to the radially inner face of the base 15 and forms with the latter a rabbet 19.

This rabbet 19 houses the radially outer portion of the snap ring 8, the radially inner portion of which is partially accommodated in the slot 12.

The snap ring 8 has two parallel axial faces perpendicular to the rotation axis of the disc 1, namely an outside axial face 20 bearing against the inside face of the collar 13 and an inside axial face 21 bearing against the outside face 18 of the foot 16, and its peripheral surface 22 bears against the radially inner face of the base 15.

Figure 7:
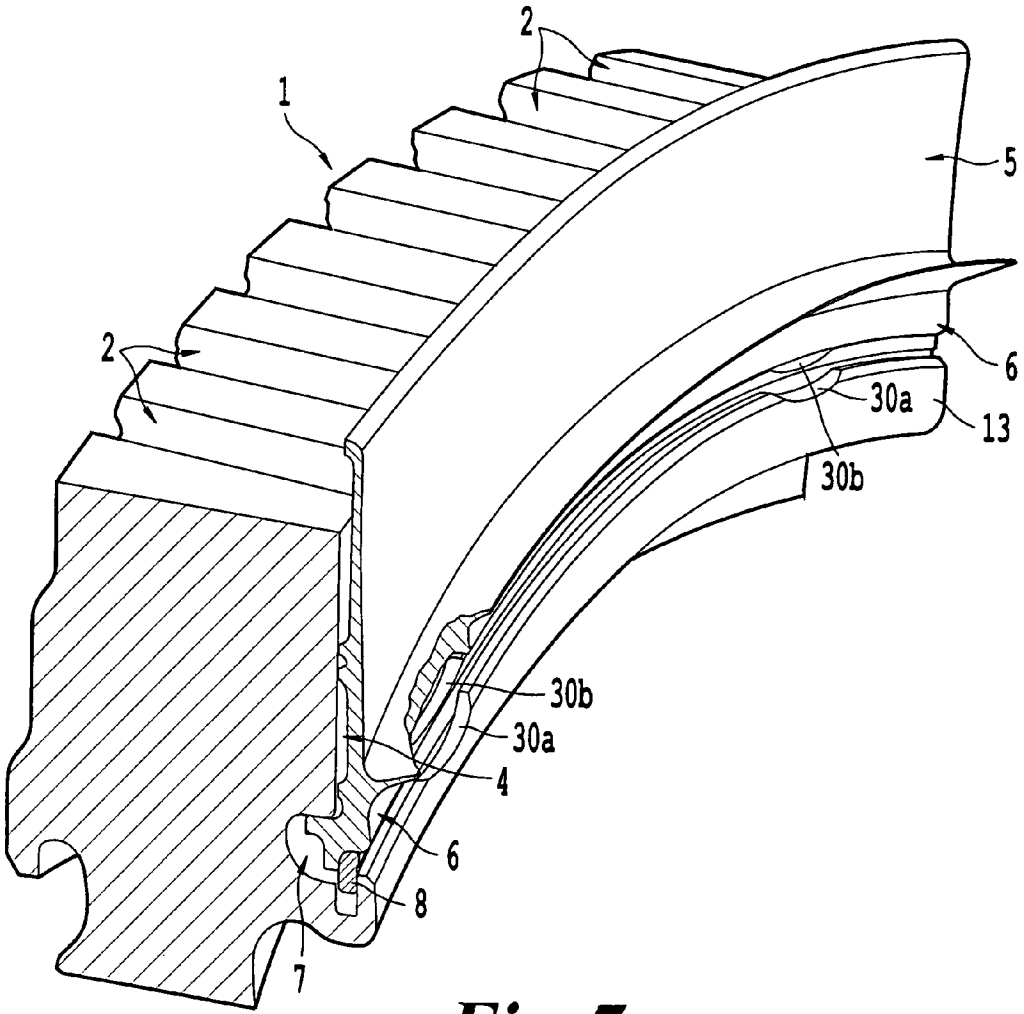
FIG. 7 shows a perspective view of the present invention such that multiple notches are visible in each of the collar and snap ring.

In order to allow the assembly or disassembly of the end plate 5, the snap ring 8 is retracted into the slot 12 by means of compression tools. As can clearly be seen in FIG. 7, the collar 13 and the periphery of the snap ring 8 have, when joined, a plurality of notches 30*a* on the collar 13 and 30*b* on the snap ring 8, in which notches the claws 25 of the compression tools are positioned, these claws being dimensioned such that, when the snap ring 8 is retracted, since the walls delimiting the pairs of notches 30*a* and 30*b* are aligned, the claws 25 retract into the diameter or the contour of the collar 13 and are then positioned in the geometric cylinder defined by the bore 17 in the foot 16.

The depth of the slot 7 is calculated to allow the retraction of the claws 25 during the compression of the snap ring 8.

Figure 3:
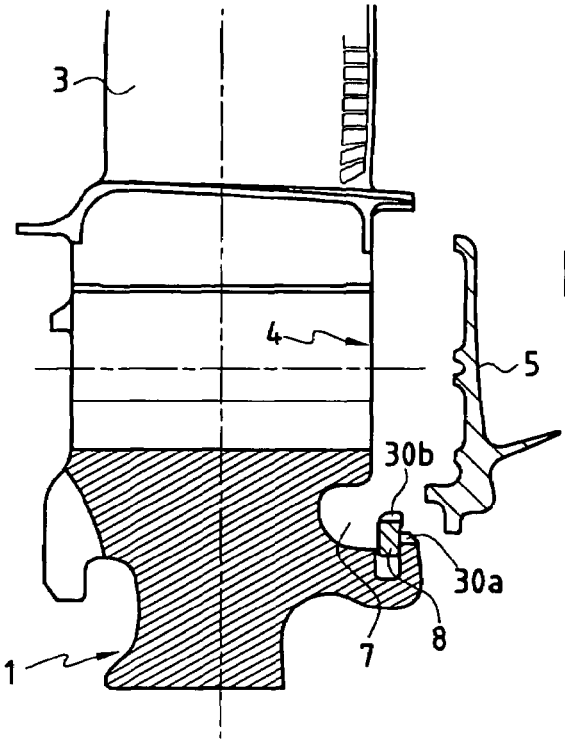
FIG. 3 shows the positioning of the snap ring prior to the mounting of the end plate.

Prior to the mounting of the end plate 5, the snap ring 8 is introduced into the recess 7, its radially inner part preferably being in the slot 12, as shown in FIG. 3. The claws 25 of the compression tool are spread outwards and they are disposed in the notches 30*b* in the snap ring 8. The claws 25 are brought towards the rotation axis of the disc 1 by clamping, thereby compressing the snap ring 8, which retracts into the slot 7.

Figure 4:
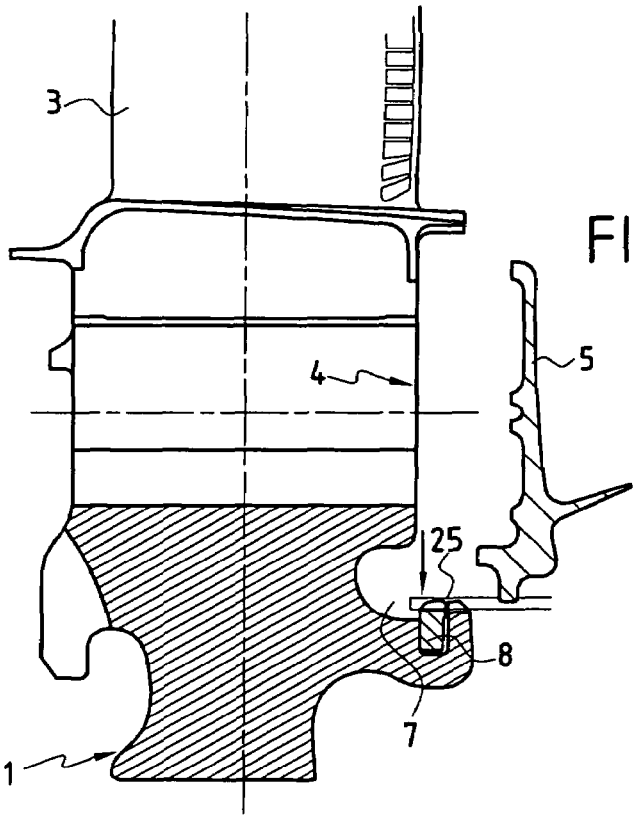
FIGS. 4 to 6 show the various stages of assembly of the end plate.
Figure 5:
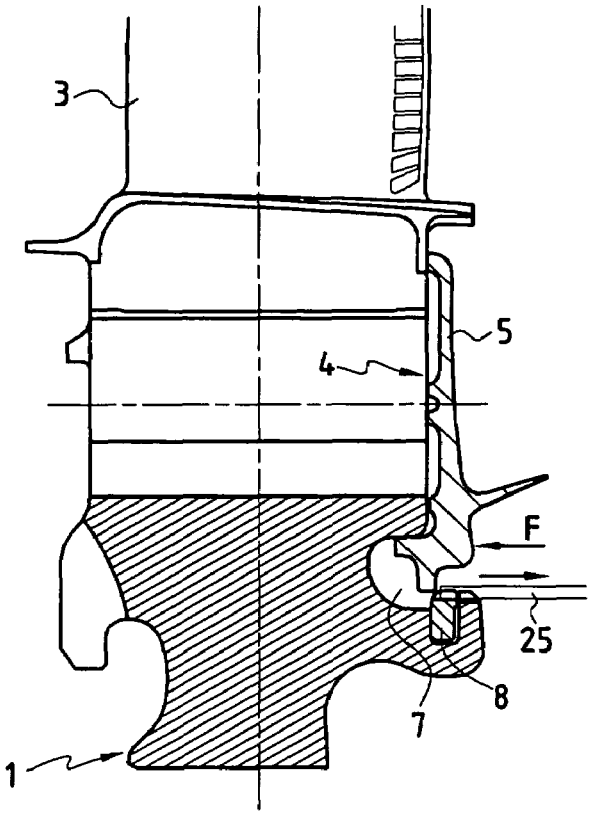
Figure 6:
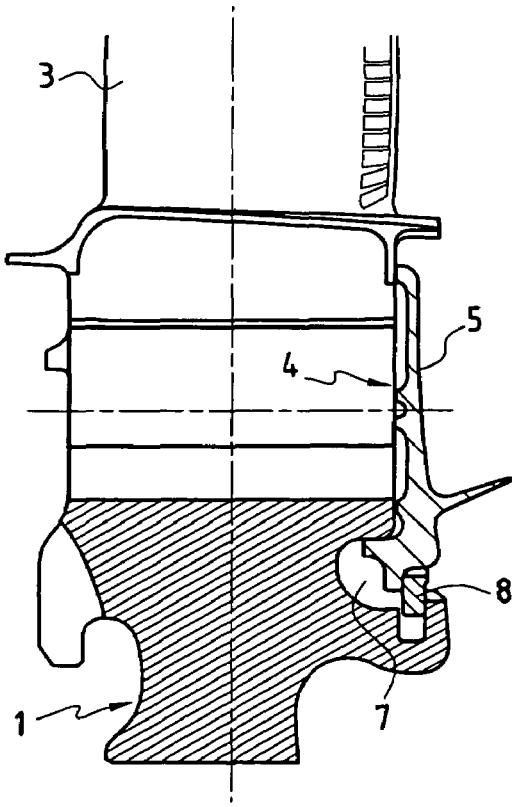

When the claws 25 are bearing against the notches 30*a* in the collar 13, as is shown in FIG. 4, the end plate 5 is brought up to the disc 1 and the foot 16 is passed over the collar 13, the snap ring 8 and the claws 25. The end plate 5 is then placed flush against the axial face 4 through the application of an axial pressure F thereto, after which the claws 25 are withdrawn, as is represented by an arrow in FIG. 5. The snap ring 8 then expands and its periphery 22 comes to bear against the base 15. The axial pressure F exerted on the end plate 5 is relieved and the snap ring 8 is then compressed between the foot 16 and the collar 13, as is shown in FIG. 6. The disassembly of the end plate 5 is effected according to the reverse process.

The diameter of the shoulder 14 can be equal to the diameter of the collar 13. Advantageously, however, the diameter of the shoulder 14 is equal to or less than the diameter of the bottom of the notches 30*a* in the collar 13. This arrangement allows the claws 25 to extend over the shoulder 14, as the snap ring 8 is compressed, without disturbing the assembly of the end plate 5.

The inner diameter of the snap ring 8, not subjected to stresses, is preferably less than the diameter of the shoulder 14 in order that the snap ring 8 is correctly positioned relative to the slot when the claws 25 are fitted in the notches 30*b* in the snap ring 8.

When the slot 7 emerges onto the face 4 of the disc 1, the fitting of the snap ring 8 on the disc 1 is easier.

The snap ring 8, which appears in the form of a split washer, is easy to make and inexpensive. In addition, the volume of the recess 7 can be maximally limited, thereby reinforcing the periphery of the disc 1, which periphery is generally subjected to considerable centrifugal forces.

The invention claimed is:

1. A device for holding an annular end plate against a radial face of a rotor disc, the disc having in the radial face an annular recess delimited by a plurality of walls, one of which is formed by an inside face of a collar extending radially outwards, and the end plate having, in its radially inner part, an annular base bearing against a radially outer wall of the recess and a foot extending radially inwards in the recess from the base, the device comprising:

a split annular retaining ring disposed in the recess, this ring having a first radial surface bearing against the inside face of the collar, a second radial surface bearing against an axially outside face of the foot and a peripheral surface butting against the foot or the base, wherein the ring is a snap ring interposed axially between the foot of the end plate and the collar, and the peripheral surface of the ring butts against the base, the peripheral surface of the ring including a first plurality of notches and the collar including a corresponding second plurality of notches, both first and second plurality of notches open radially outwards and are configured to line up to receive compression tools for the snap ring, which tools retract into a contour of the collar during assembly or disassembly of the end plate.

2. The device according to claim 1, wherein a radially inner portion of the snap ring is accommodated in a slot made behind the collar.

3. The device according to claim 2, wherein the slot has a U-shaped section.

4. The device according to either of claims 2 or 3, wherein a shoulder formed by the slot and a wall of the cavity has a diameter equal to or less than a diameter of the collar.

5. The device according to claim 4, wherein the diameter of the shoulder is equal to or less than a diameter of a bottom of the notches in the collar.

6. The device according to claim 2, wherein the snap ring has flat, opposing radial faces and a thickness of the snap ring is equal to or less than a width of the slot.

7. The device according to claim 1, wherein the foot of the end plate has a bore, a diameter of which is substantially equal to a diameter of the collar.

8. A turbomachine including the device according to claim 1.

9. A device comprising:

a disc having in a radial face an annular recess delimited by a plurality of walls, one of which is formed by an inside face of a collar extending radially outwards;

an end plate having in a radially inner part an annular base bearing against a radially outer wall of the recess and a foot extending radially inwards in the recess from the base;

a split annular retaining ring disposed in the recess, the ring having a first radial surface bearing against an inside face of the collar, a second radial surface bearing against an axially outside face of the foot, and a peripheral surface butting against the foot or the base, the ring being a snap ring interposed axially between the foot of the end plate and the collar, and the peripheral surface of the ring butting against the base, the peripheral surface of the ring including a first plurality of notches and the collar including a corresponding second plurality of notches, both first and second plurality of notches open radially outwards and are configured to line up to receive compression tools for the snap ring, which tools retract into the contour of the collar during assembly or disassembly of the end plate.

10. The device according to claim 9, wherein a radially inner portion of the snap ring is accommodated in a slot made behind the collar.

11. The device according to claim 10, wherein the slot has a U-shaped section.

12. The device according to claim 10, wherein a shoulder formed by a slot and a wall of the cavity has a diameter equal to or less than a diameter of the collar.

13. The device according to claim 12, wherein the diameter of the shoulder is equal to or less than a diameter of a bottom of the notches in the collar.

14. The device according to claim 10, wherein the snap ring has flat, opposing radial faces and a thickness of the snap ring is equal to or less than a width of the slot.

15. The device according to claim 9, wherein the foot of the end plate has a bore, a diameter of which is substantially equal to a diameter of the collar.

16. A turbomachine including the device according to claim 9.

17. A device comprising:

a disc having in a radial face an annular recess delimited by a plurality of walls, one of which is formed by an inside face of a collar extending radially outwards;

an end plate having in a radially inner part an annular base bearing against a radially outer wall of the recess and a foot extending radially inwards in the recess from the base;

retaining means disposed in the recess, the retaining means having a first radial surface bearing against an inside face of the collar, a second radial surface bearing against an axially outside face of the foot, and a peripheral surface butting against the foot or the base, the retaining means being a snap retaining means interposed axially between the foot of the end plate and the collar, and the peripheral surface of the retaining means butting against the base, the peripheral surface of the retaining means including a first plurality of notches and the collar including a corresponding second plurality of notches, both first and second plurality of notches open radially outwards and are configured to line up to receive compression tools for the snap retaining means, which tools retract into the contour of the collar during assembly or disassembly of the end plate.

18. The device according to claim 17, wherein the foot of the end plate has a bore, a diameter of which is substantially equal to a diameter of the collar.

19. A turbomachine including the device according to claim 17.

* * * * *